US009669253B2

(12) United States Patent
Fleming et al.

(10) Patent No.: US 9,669,253 B2
(45) **Date of Patent: *Jun. 6, 2017**

(54) FOLD AND ROLL EXERCISE MAT

(71) Applicants: Heather Fleming, Palo Alto, CA (US); Mark Fleming, Palo Alto, CA (US)

(72) Inventors: Heather Fleming, Palo Alto, CA (US); Mark Fleming, Palo Alto, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/575,940

(22) Filed: Dec. 18, 2014

(65) Prior Publication Data

US 2015/0297941 A1 Oct. 22, 2015

Related U.S. Application Data

(63) Continuation-in-part of application No. 14/512,278, filed on Oct. 10, 2014, now abandoned.

(60) Provisional application No. 61/890,183, filed on Oct. 12, 2013.

(51) Int. Cl.
*A63B 26/00* (2006.01)
*A63B 21/00* (2006.01)

(52) U.S. Cl.
CPC ..... *A63B 21/4037* (2015.10); *A63B 2210/50* (2013.01)

(58) Field of Classification Search
CPC ..... A47G 27/0237; A47G 9/06; A47G 9/062; A47G 9/08; A47G 9/083; A47G 9/086; A47D 15/003; A63B 21/4037; A63B 2210/50
USPC ..... 5/417, 420
See application file for complete search history.

(56) References Cited

U.S. PATENT DOCUMENTS 4,370,767 A * 2/1983 Fraser ..... A47C 1/143 5/417
4,601,076 A * 7/1986 Knobeloch ..... A47C 17/70 5/413 R
4,662,851 A * 5/1987 Foster ..... B63C 9/08 441/129
4,985,952 A * 1/1991 Edelson ..... A47C 27/001 150/158
5,066,001 A * 11/1991 Wilkinson ..... A63B 6/00 482/52
5,265,292 A * 11/1993 Underell ..... A47C 4/52 297/380
5,386,603 A * 2/1995 Drust ..... A47G 9/062 5/417
5,774,912 A * 7/1998 Dominique ..... A45C 3/10 383/4
5,970,541 A * 10/1999 Chiang ..... A47D 11/00 5/420
6,393,638 B1 * 5/2002 MacColl ..... A45F 4/02 383/4
6,618,883 B2 * 9/2003 Angland ..... A47C 17/04 5/12.1
6,751,816 B1 * 6/2004 Wechsler ..... A45F 3/14 383/4
7,036,162 B1 * 5/2006 Gatten ..... A47C 21/04 5/420
7,987,536 B1 * 8/2011 Habig ..... A47G 9/083 5/413 R (Continued)

*Primary Examiner* — Nicholas Polito
(74) *Attorney, Agent, or Firm* — Larisa Migachyov

(57) ABSTRACT

A yoga mat comprising a folding hinge, said yoga mat designed to be folded and then rolled up while it is folded.

17 Claims, 7 Drawing Sheets

(56) References Cited

U.S. PATENT DOCUMENTS

| | | | | |
|---|---|---|---|---|
| 2012/0073046 | A1* | 3/2012 | Inge | A47G 9/062 5/420 |
| 2012/0233772 | A1* | 9/2012 | Wang | A47G 27/0237 5/417 |
| 2013/0042408 | A1* | 2/2013 | Sun | A47G 27/0237 5/417 |
| 2013/0305450 | A1* | 11/2013 | Douglas | A47G 9/0223 5/484 |
| 2014/0068858 | A1* | 3/2014 | Wambeke | A47G 9/062 5/420 |

* cited by examiner

FOLD AND ROLL EXERCISE MAT

CROSS-REFERENCE TO RELATED APPLICATIONS

The present application is a continuation-in-part of application Ser. No. 14/512,278, filed Oct. 10, 2014, which takes priority from Provisional App. No. 61/890,183, filed Oct. 12, 2013, which is herein incorporated by reference.

BACKGROUND

Gym floors are not always very sanitary places. They typically teem with bacteria, some of which are merely smelly, and some of which are more dangerous (such as MRSA). A person doing yoga has to spread their mat on this dirty floor. When the yoga session is over, the exerciser typically rolls up their mat; because of the way yoga mats typically roll up, the "dirty" side that touched the floor ends up in direct contact with the "clean" side that the person was on. This means that the whole mat is now "dirty" and covered in nasty bacteria.

One way to deal with the problem, of course, is to wash the mat after each practice; however, this is hard to commit to on a regular basis. Some folding yoga mats exist; however, they typically do not isolate the "dirty" side adequately. Also, a folded yoga mat does not have the same shape as a rolled-up yoga mat and thus does not fit into the same bags or receptacles.

Another prior-art invention, U.S. Pub. No. 2013/0042408, comprises a regular yoga mat with a guideline for folding the yoga mat in the middle, and then rolling up the folded yoga mat. This way, the "dirty" side of the yoga mat only touches the "dirty" side when the mat is folded. The problem with that invention is that folding a yoga mat in this way means that there will be a "bump" in the middle of the mat when it is unrolled, due to the stress that the folding places on the mat. Also, the repeated folding and unfolding may damage the material of the mat in the long term. Finally, it is difficult to fold the mat precisely when there is no tactile guideline for how to fold it appropriately prior to rolling it up.

A need exists for a fold-and-roll mat that is easier to fold in exactly the right place for the edges to line up precisely when it is rolled up, and that does not have a "bump" in the middle or risk damaging the material of the mat.

SUMMARY OF THE INVENTION

An object of the present invention is to provide a yoga mat that prevents the top side and bottom side of the mat from coming into contact with each other when the mat is rolled.

Another object of the present invention is to provide a yoga mat that is easier to keep sanitary.

Another object of the present invention is to provide a yoga mat that is easy to fold in such a way that the edges of the mat line up when the mat is rolled up after being folded.

The yoga mat of the present invention comprises a first portion and a second portion, connected by a flexible hinge, the hinge being more flexible than either the first or the second portion.

In an embodiment, the hinge is parallel to the short end of the yoga mat. In another embodiment, the hinge is located at approximately 50% of the length of the yoga mat. In another embodiment, the hinge is parallel to the long end of the yoga mat.

The hinge can be an integral part of the material of the mat, produced by embossing or cutting away part of the mat's material, or can be a separate strip of material attaching the front portion to the back portion. The separate strip of material can be sewn, glued, heat-welded, or otherwise attached to the mat.

In another embodiment, the hinge may be separable, allowing the first portion to be separated from the second portion. The hinge may be formed by a zipper, Velcro, or snaps.

In an embodiment, the hinge comprises finger loops on each end of the hinge to make the mat easier to pick up and fold. In another embodiment, the hinge is less flexible in the direction perpendicular to its fold than in the direction in which it folds; this makes it easier to pick up and fold the mat.

In an embodiment, the hinge comprises fastening attachments that make it easier to keep the mat from unrolling once it is rolled up. The fastening attachments may be two ties, one on each end of the hinge, an elastic loop on one end of the hinge that is large enough to stretch over the mat, or any other fastener that prevents the mat from unrolling.

In an embodiment, advertising messages or other decorative patterns may be printed on the material of the hinge.

DETAILED DESCRIPTION OF THE PREFERRED EMBODIMENT

Figure 1:
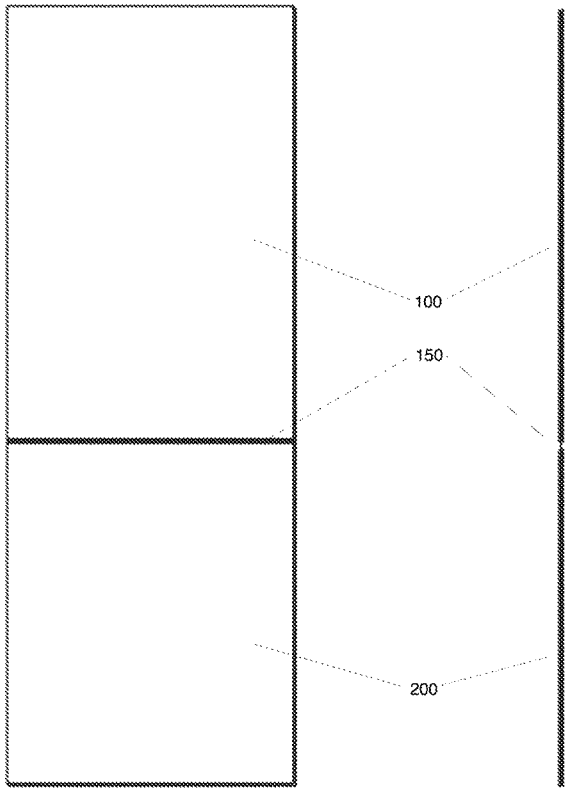
FIG. 1 shows a front view and a side view of the exercise mat of the present invention.

FIG. 1 shows a mat of the preferred embodiment of the present invention. The mat is preferably made of the same material as a standard yoga mat, and is the same dimensions as a standard yoga mat, though it can be any other size and proportions. Front portion 100 and back portion 200 are connected by hinge 150. The hinge is preferably located at about 50-60% of the length of the mat, depending on the thickness, length, texture, and material of the mat. The hinge is preferably significantly more flexible than the rest of the mat and strong enough to handle repeated flexing over the life of the mat.

Figure 2:
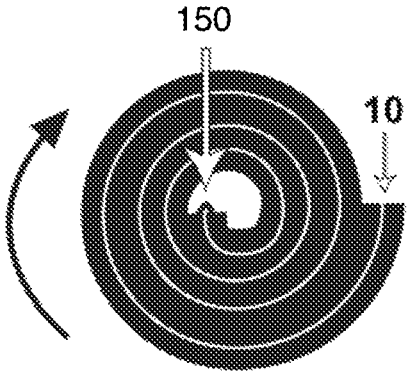
FIG. 2 shows a cross-sectional view of the rolled-up exercise mat of the present invention.

When the mat is no longer being used, it can be folded and rolled up. To fold the mat, the user picks it up by the two ends of the hinge so that it folds up. The "dirty" side of the front portion is then in contact with the "dirty" side of the back portion. After folding the mat along the hinge, the user rolls it up, starting with the folded hinge. In the preferred embodiment, the hinge 150 is located in such a way that when the mat is rolled up after being folded, the edges of the front portion and the back portion line up 10, as shown in FIG. 2. However, this is not required, and in other embodiments, the edges do not line up exactly. The precise location of the hinge along the length of the mat is dependent on the thickness of the mat and the flexibility of the material of the front portion and the back portion, as those will both affect the exact difference between the length of the front portion and the length of the back portion required for the edges to line up when the mat is rolled up.

The hinge may be thinner than the rest of the mat, and may be made of any material as long as it is more flexible than the rest of the mat. In an embodiment, the hinge is made by embossing a thin strip of the material of the mat that separates the front portion from the back portion. In another embodiment, the hinge is made by cutting away part of the thickness of the material in the region that separates the front portion from the back portion.

The hinge may also be made of a different material from the material of the front portion and the back portion of the mat. For example, it may be made of a thin strip of rubber or plastic. In that embodiment, the hinge may be attached to the front and back portions by stitching, heat-welding, adhesives, or any other method of attachment that is secure and that stands up to repeated folding and unfolding.

Figure 6:
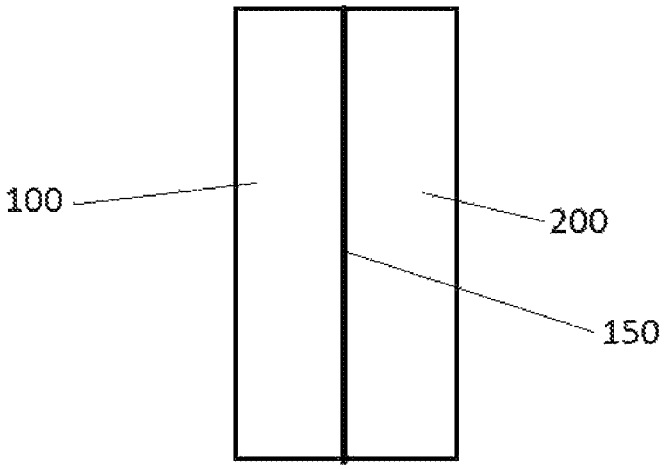
FIG. 6 shows a front view of an alternative embodiment of the exercise mat of the present invention.

In an embodiment, as depicted in FIG. 6, the hinge 150 is placed lengthwise between the front portion 100 and back portion 200 rather than widthwise along the mat, and the mat is then rolled up in a direction perpendicular to the hinge.

Figure 7:
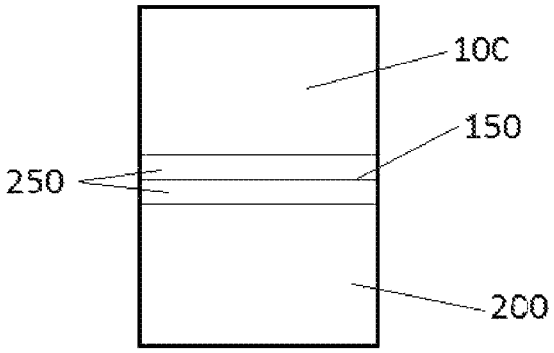
FIG. 7 shows a front view of an alternative embodiment of the exercise mat of the present invention demonstrating a padded hinge.

In an embodiment, represented by FIG. 7, the hinge 150 is thicker than the rest of the first portion 100 and second portion 200 of the mat and comprises padding 250. Since the hinge 150 is located close to the midpoint of the mat, it is often desirable to have a padded location there to support the knees for kneeling poses or to support the hands in poses where the hands bear weight. The padding 250 can be located on the side of the hinge 150 that is on the outside of the fold when the hinge 150 is folded, to prevent it from interfering with the fold. The padding 250 may be made of foam rubber, foam, cotton, or any other padding material.

In an embodiment, the hinge is separable and allows the first portion to be separated from the second portion. For example, it may be a zipper, Velcro, snaps, or any other fastener. This would make the mat easier to clean.

In an embodiment, the hinge is more rigid in the direction perpendicular to its fold than in the direction in which it is folded, and more rigid than the front portion and the back portion of the mat. This assists the user in lifting up the mat when it is time to fold it.

Figure 3:
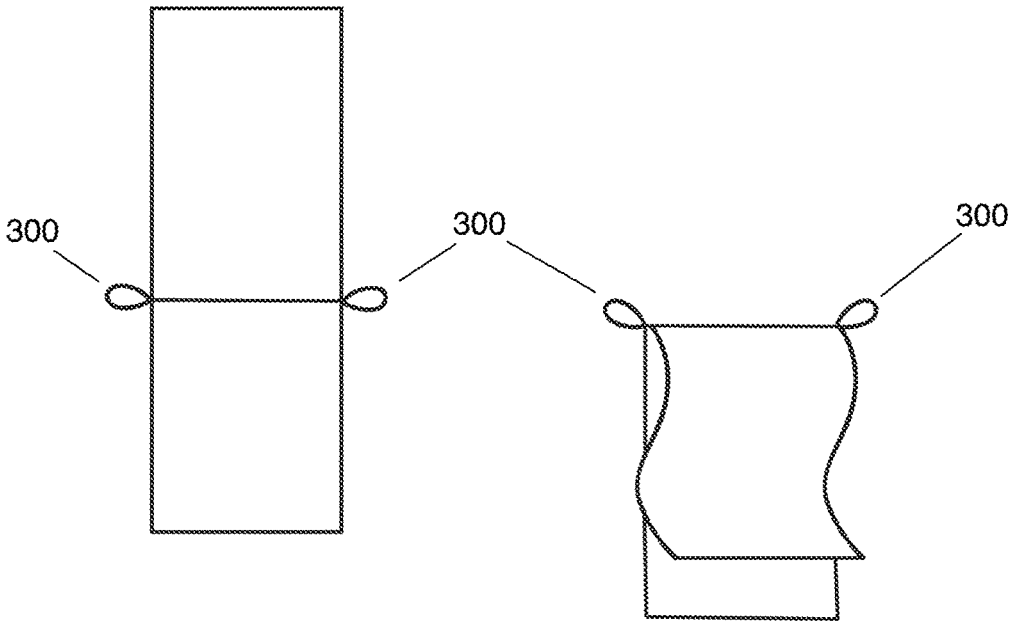
FIG. 3 shows two views of an alternate embodiment of the exercise mat of the present invention.

The hinge can also comprise handles 300 on either side of the hinge to assist the user in lifting the mat from the floor, as shown in FIG. 3. The handles are preferably small and unobtrusive to not get in the way either during yoga practice or while the mat is rolled up. In the preferred embodiment, they are small loops of material that can be hooked with a finger, as shown in the Figure.

Figure 4:
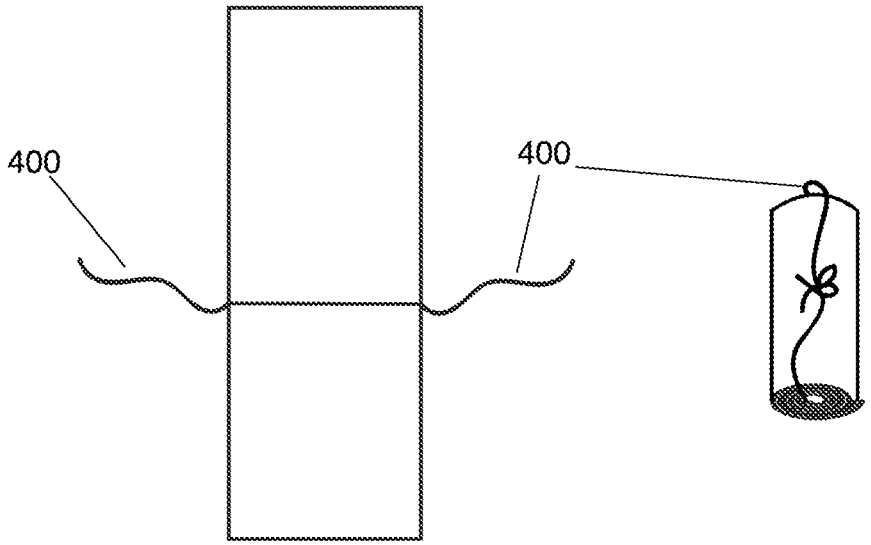
FIG. 4 shows an unrolled view and a rolled-up view of an alternate embodiment of the exercise mat of the present invention.

In an embodiment, the hinge comprises a fastener that helps keep the mat from unrolling. Such a fastener may simply be two straps 400 protruding from the hinge, one at either end of the hinge, as shown in FIG. 4. The two straps 400 may then be fastened together when the mat is rolled up, as shown in the Figure, preferably over the free ends of the mat, to keep it from unrolling. The two straps may be tied together or fastened in some other way, such as a snap, Velcro, a buckle, or any other fastener known in the art. In another embodiment (not shown), the straps are fastened to the mat itself along its outer edge.

Figure 5:
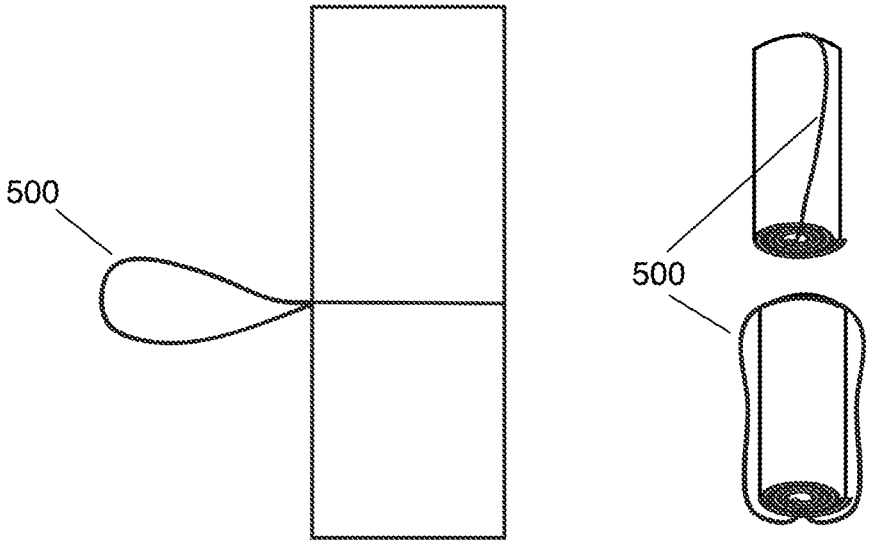
FIG. 5 shows an unrolled view and a rolled-up view of an alternate embodiment of the exercise mat of the present invention.

Another embodiment of the fastener, as shown in FIG. 5, may be an elastic loop 500 attached to one end of the hinge, the elastic loop large enough to stretch over the rolled-up mat to keep it from unrolling. The elastic loop may be of the same material as the hinge, or may be attached to the hinge by adhesives, stitching, or other forms of fastener.

The hinge may comprise advertising messages or yoga instructions or decorative elements printed on it, to improve the aesthetics of the mat.

The invention claimed is:

1. A rectangular exercise mat having a long edge and a short edge, comprising:

a first portion, said first portion comprising an inside edge and an outside edge;

a second portion, said second portion comprising an inside edge and an outside edge;

one and only one hinge parallel to the short edge, said hinge connecting the inside edge of the first portion and the inside edge of the second portion, said hinge more flexible than a material of the first portion or the second portion, said hinge enabling the exercise mat to fold;

a first handle attached to one end of the hinge; and a second handle attached to the other end of the hinge;

such that the exercise mat can be rolled up after it is folded such that the outside edge of the first portion lines up with the outside edge of the second portion after the exercise mat is rolled up.

2. The exercise mat of claim 1, wherein the hinge is located approximately halfway along the long edge.

3. The exercise mat of claim 1, wherein the exercise mat is rolled up in a direction parallel to the hinge.

4. The exercise mat of claim 1, wherein the hinge is made of a flexible strip of material that is strong enough to handle repeated folding, wherein the flexible strip of material comprises material that is distinct from at least one of the first portion and the second portion.

5. The exercise mat of claim 1, wherein the hinge is separable.

6. The exercise mat of claim 5, wherein the hinge is one of the following: snaps, a zipper, a hook and loop fastener.

7. The exercise mat of claim 1, wherein the hinge is created by embossing a crease in the material of the mat, said crease separating the first portion from the second portion.

8. The exercise mat of claim 1, wherein the hinge is created by cutting away part of the material of the mat in the region separating the first portion from the second portion.

9. The exercise mat of claim 1, wherein the width of the hinge is 3 inches or less.

10. The exercise mat of claim 1, wherein the hinge is attached to the first portion and the second portion by stitching.

11. The exercise mat of claim 1, wherein the hinge is attached to the first portion and the second portion by adhesive.

12. The exercise mat of claim 1, wherein the hinge is attached to the first portion and the second portion by heat welding.

13. The exercise mat of claim 1, further comprising: a fastening member attached to the hinge, said fastening member used to prevent the exercise mat from unrolling when it is in a rolled-up condition.

14. The exercise mat of claim 1, where the hinge comprises padding, said padding attached to the hinge on the side of the exercise mat opposite the floor when the mat is in use.

15. The exercise mat of claim 14, wherein the padding is of sufficient size to enable a human to kneel comfortably on it.

16. The exercise mat of claim 14, wherein the padding is made of foam.

17. A method of rolling up a rectangular exercise mat for hygienic transport, comprising the steps of:

providing a rectangular exercise mat having:

a long edge and a short edge;

a bottom side and a top side, with the bottom side resting on the floor during use;

a first portion, said first portion comprising an inside edge and an outside edge;

a second portion, said second portion comprising an inside edge and an outside edge; and one and only one hinge parallel to the short edge, said hinge connecting the inside edge of the first portion and the inside edge of the second portion, said hinge more flexible than a material of the first portion or the second portion, said hinge enabling the exercise mat to fold, wherein said hinge is located in such a way that the outside edge of the first portion lines up exactly with the outside edge of the second portion once the exercise mat is rolled up;

folding the exercise mat along the hinge in such a way that the bottom side of the first portion touches the bottom side of the second portion; and rolling up the exercise mat, starting at the hinge.

* * * * *